US007357534B2

(12) United States Patent
Snyder

(10) Patent No.: US 7,357,534 B2
(45) Date of Patent: Apr. 15, 2008

(54) FLASHLIGHT PROVIDING THERMAL PROTECTION FOR ELECTRONIC ELEMENTS THEREOF

(75) Inventor: Mark W. Snyder, Hockessin, DE (US)

(73) Assignee: Streamlight, Inc., Eagleville, PA (US)

( * ) Notice: Subject to any disclaimer, the term of this patent is extended or adjusted under 35 U.S.C. 154(b) by 25 days.

(21) Appl. No.: 11/394,633

(22) Filed: Mar. 31, 2006

(65) Prior Publication Data

US 2007/0236920 A1 Oct. 11, 2007

(51) Int. Cl.
*F21V 29/00* (2006.01)

(52) U.S. Cl. ..... 362/294; 362/202; 362/208; 362/373; 362/800

(58) Field of Classification Search ..... 362/202, 362/204, 205, 294
See application file for complete search history.

(56) References Cited

U.S. PATENT DOCUMENTS 4,313,272 A 2/1982 Matthews
4,531,178 A 7/1985 Uke
4,683,523 A 7/1987 Olsson et al.
4,729,076 A * 3/1988 Masami et al. ..... 362/235
4,885,668 A 12/1989 Maglica et al.
5,309,337 A 5/1994 Groben
5,404,281 A 4/1995 Parker
5,463,541 A 10/1995 Greene
5,678,921 A 10/1997 Kish et al.
5,785,418 A * 7/1998 Hochstein ..... 362/373
5,821,695 A * 10/1998 Vilanilam et al. ..... 315/58
6,819,505 B1 11/2004 Cassarly et al.
6,827,468 B2 12/2004 Galli
6,942,365 B2 9/2005 Galli
6,966,677 B2 11/2005 Galli
6,974,234 B2 12/2005 Galli
7,008,084 B2 3/2006 Galli
7,014,335 B2 3/2006 Probst et al.
7,055,989 B2 6/2006 Galli
7,083,305 B2 8/2006 Galli
2005/0017366 A1 1/2005 Galli
2005/0024864 A1* 2/2005 Galli ..... 362/202
2005/0057187 A1 3/2005 Catalano
2005/0122713 A1 6/2005 Hutchins
2005/0161684 A1 7/2005 Galli
2005/0161692 A1 7/2005 Galli
2005/0201100 A1 9/2005 Cassarly et al.
2005/0243558 A1 11/2005 Van Duyn
2006/0013000 A1 1/2006 Coushaine et al.
2006/0039139 A1 2/2006 Maglica et al.
2006/0067077 A1 3/2006 Kumthampinij et al.
2006/0109655 A1 5/2006 Martin
2006/0145180 A1 7/2006 Galli

* cited by examiner

*Primary Examiner*—Sandra O'Shea
*Assistant Examiner*—Mary Zettl
(74) *Attorney, Agent, or Firm*—Clement A. Berard, Esq; Dann, Dorfman, Herrell & Skillman, PC

(57) ABSTRACT

A portable light including thermal protection comprises a thermally-conductive heat sink having a heat dissipating part and a heat collecting part; a light source having a surface thermally coupled to the heat collecting part of the heat sink; an electronic circuit for controlling the light source, wherein the electronic circuit is adjacent the heat collecting portion of the heat sink; and a thermally-conductive material between the electronic circuit and the heat collecting part of the heat sink for providing a thermally conductive path therebetween.

37 Claims, 3 Drawing Sheets

FLASHLIGHT PROVIDING THERMAL PROTECTION FOR ELECTRONIC ELEMENTS THEREOF

The present invention relates to a light having electronic elements therein and, in particular, to a portable light providing thermal protection for the electronic elements therein.

Increasingly, flashlights and other portable lights are employing a solid state light source, such as a light-emitting diode (LED), particularly as the brightness of the available LEDs has improved and as LEDs have become available that produce bright "white" light.

Unlike incandescent lamps which depend upon the heating of a light producing filament to a high temperature to produce light, LEDs are desirably operated at lower temperatures at which their efficiency and reliability is better. Thus, whereas it was relatively unimportant in many instances to remove the heat generated by an incandescent lamp, it may be quite important that heat generated by a high-power LED be removed.

While incandescent lamps may be satisfactorily operated by applying a voltage, e.g., a battery voltage, directly to the lamp, such is not a desirable way in which to operate a solid state light source such as an LED. Thus, along with the use of LEDs as light sources in portable lights has come the utilization of electronic circuits for conditioning the electrical power provided by an electrical power source into a form more suitable for the LED, for example, for controlling the level of current flowing through the LED.

As such power regulating circuit technology has been developed, power regulating circuits have also come to be employed with incandescent light sources as well as with solid state light sources. As a result, portable lights have come to include electronic circuitry as well as the usual battery (or batteries) and light sources.

Because heat can be detrimental to electronic circuitry, there is a need to remove heat from such circuitry. In addition, certain failure and/or fault conditions may cause additional heat to be produced that could raise the temperature of electronic circuitry to a temperature that is not only detrimental to the circuitry, but that could also be a hazard or a danger to the circuitry or otherwise.

Accordingly, there is a need for heat sinking to remove heat from a light source and/or electronic circuitry of a portable light.

To this end, a portable light including thermal protection may comprise a thermally-conductive heat sink having a heat dissipating part and a heat collecting part; a light source having a surface thermally coupled to the heat collecting part of the heat sink; an electronic circuit for controlling the light source, wherein the electronic circuit is adjacent the heat collecting portion of the heat sink; and a thermally-conductive material between the electronic circuit and the heat collecting part of the heat sink for providing a thermally conductive path therebetween.

BRIEF DESCRIPTION OF THE DRAWING

The detailed description of the preferred embodiment(s) will be more easily and better understood when read in conjunction with the FIGURES of the Drawing which include.

Figure 1:
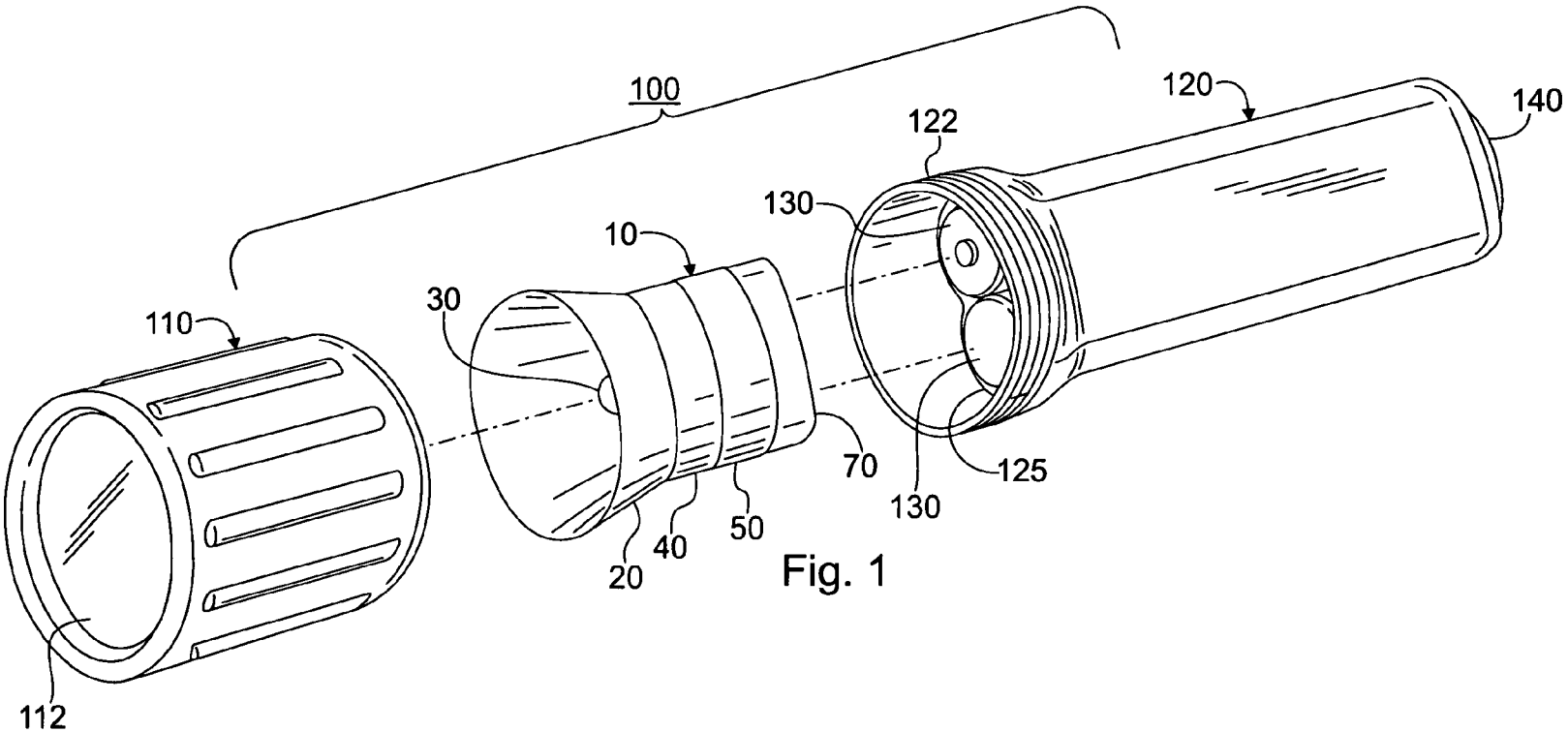
FIG. 1 is an exploded view of an example embodiment of a portable light.

In the Drawing, where an element or feature is shown in more than one drawing figure, the same alphanumeric designation may be used to designate such element or feature in each figure, and where a closely related or modified element is shown in a figure, the same alphanumerical designation primed or designated "a" or "b" or the like may be used to designate the modified element or feature. Similarly, similar elements or features may be designated by like alphanumeric designations in different figures of the Drawing and with similar nomenclature in the specification. It is noted that, according to common practice, the various features of the drawing are not to scale, and the dimensions of the various features are arbitrarily expanded or reduced for clarity, and any value stated in any Figure is given by way of example only.

DESCRIPTION OF THE PREFERRED EMBODIMENT(S)

FIG. 1 is an exploded view of an example embodiment of a portable light 100. Portable light 100 typically includes a housing 120 and a lens cap 110 that may be threadingly attached thereto using threads 122 to provide a closed housing for the light source 10 and battery or batteries 130 of light 100. Lens cap 110 typically provides a lens 112 through which light produced by light producing part 10 may be directed away from light 100. Portable light housing 120 typically has a cavity for receiving one or more batteries 130, and has one or more electrical switches 140 for selectively connecting the battery or batteries 130 in circuit with light source part 10 for selectively energizing light producing part 10 to produce light.

In the illustrated example, housing 120 may have four batteries, e.g., four size AA batteries, of which two batteries 130A, 130B are visible, in cavity 125 thereof. Batteries 130A, 130B may be inserted in opposite orientations so that the central contact (usually the positive terminal) of battery 130A is exposed and so that the end contact (usually the negative terminal) of battery 130B is exposed, which also simplifies the connection between batteries 130A and 130B at the rearward end of housing 120.

Light producing part 10 may include a reflector 20, a light source (not visible), a heat sink 40, an insulating housing 50, and optionally a contact holder 70, and may also include an electronic circuit board (not visible) interior thereto.

The one or more electrical switches 140, which may be associated with housing 120 or with light producing part 10, may selectively connect the batteries 130 in circuit with the electronics circuit board and with the light source assembly for selectively energizing light producing part 10 to produce light through lens 112.

Figure 2:
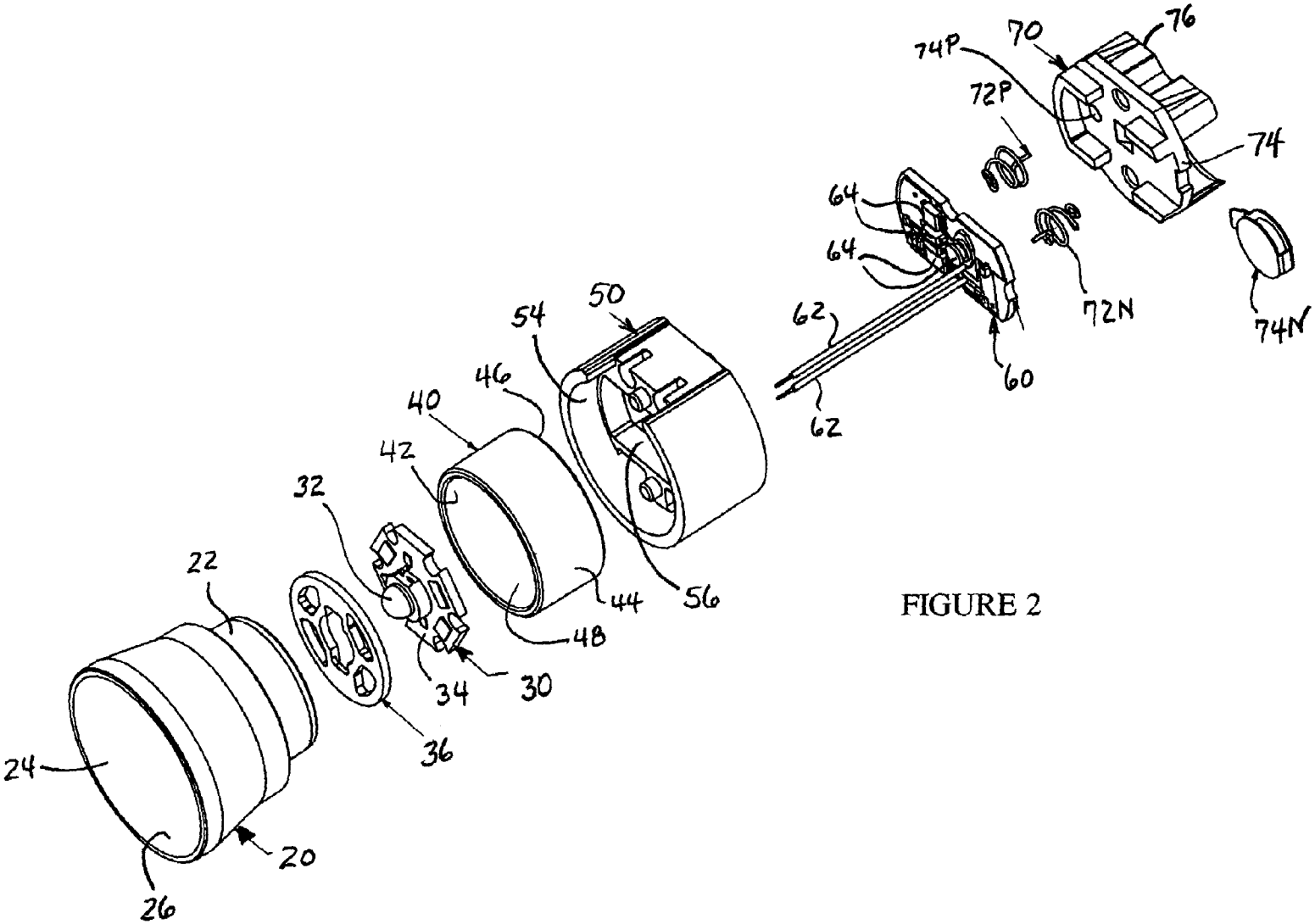
FIG. 2 is an exploded view of an example embodiment of a part of the portable light of FIG. 1 illustrating the electronic and other elements thereof.
Figure 3:
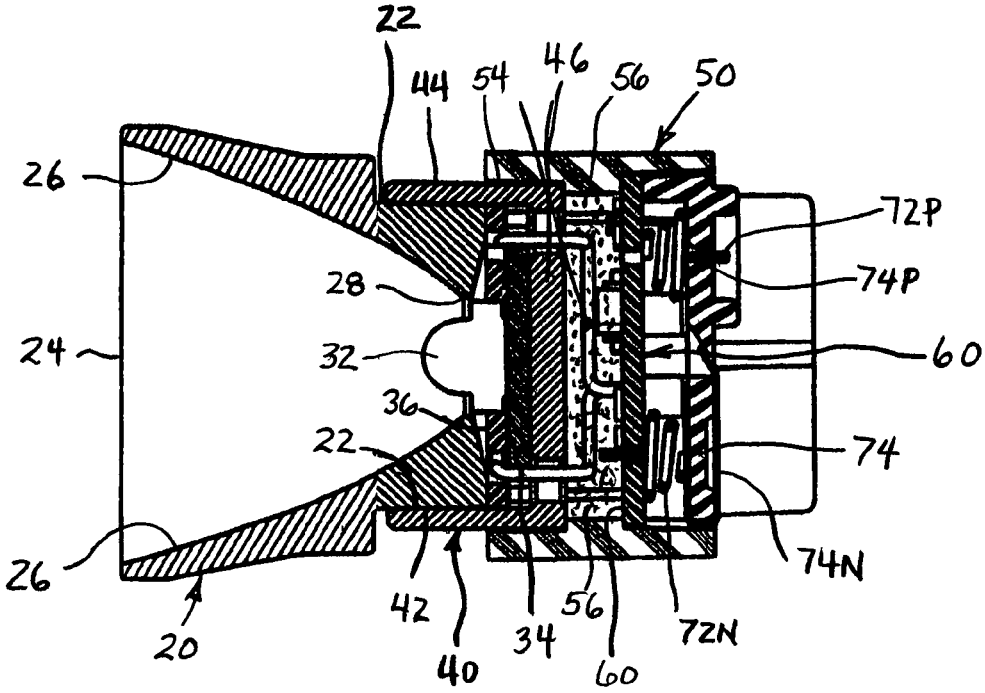
FIG. 3 is a side cross-sectional view of the example embodiment of the portable light part of FIG. 2.

FIG. 2 is an exploded view of an example embodiment of a part 10 of the portable light 100 of FIG. 1 illustrating the electronic and other elements thereof, and FIG. 3 is a side cross-sectional view of the example embodiment of the portable light part 10 of FIG. 2. Light producing part 10 thereof typically may include a reflector 20, a light source assembly 30, a heat sink 40, a circuit board housing 50, and an electronic circuit board 60. Light source 10 may also include a contact holder 70. Typically, light source assembly 30 and electronic circuit board 60 include electronic elements of various kinds, although electronic elements may be included in any other element of portable light 100.

Light producing part 10 may also be referred to as light source 10. Light source assembly 30 includes electronic elements, such as one or more light-emitting diodes (LEDs) 32 in the typical case of a solid state light source, and may optionally include one or more resistors and/or other electronic elements. Of the elements 20-70 of light source 10, LED assembly 30 includes electronic elements that can produce substantial heat when LED 32 thereof is electrically energized for producing light. Typically about 15% of the electrical power applied to LED 32 is converted to light and about 85% thereof is dissipated as heat that must be removed from LED 30 so as to maintain its operating temperature within acceptable limits.

It is desirable to maintain the operating temperature of LED 32 substantially below its operating temperature limit in order to obtain better electrical-to-light conversion efficiency and better reliability. By providing effective heat sinking, e.g., via heat sink 40 and reflector 20, LED 32 may be operated at a higher current thereby to be operated at higher intensity to produce more light, and by obtaining improved efficiency, light 100 may be operated for a longer time on a given battery capacity (e.g., on a given charge of a rechargeable battery, or the available charge of a single-use battery). Other electronic elements, e.g., resistors and/or transistors, if any, of LED assembly 30 typically may produce additional heat in operation.

Typically, higher power LEDs 32 that produce high intensity light as would be desirable for a portable light are sold attached to a heat conducting base 34 that is designed by the manufacturer for proper LED temperature operation when placed adjacent a suitable heat sink. Examples of such high-power LEDs are the LUXEON® LEDs available from Lumiled Lighting, U.S., LLC, located in San Jose, Calif., as well as those available from other sources such as Seoul Semiconductor located in Korea, Cree Inc. located in Durham, N.C., and CML Innovative Technologies located in Hackensack, N.J. LUXEON® and other LEDs are available, e.g., in one watt, three watt, five watt, and other power levels, for producing "white" light as well as other colors of light, e.g., red, green, blue, amber, and the like.

In addition, of the other elements of light source 10, electronic circuit 60 includes electronic elements 64 that typically produce a moderate amount of heat in normal operation and so heat sinking thereof may or may not be required under normal operating conditions. Under abnormal operating conditions, however, such as when a failure occurs in an electrical and/or electronic component 64 of circuit board 60, or when a failure of LED 32 or of another electronic element of LED assembly 30 occurs, or if a short occurs elsewhere, various components of LED assembly 30, or of electronic circuit board 60, or of both, may experience abnormal levels of power dissipation and so may tend to rise to abnormally high temperatures. Under such abnormal conditions, it is important that the temperature of any electronic element not rise above that which is considered a limit for safety, or for fire resistance, or for combustibility, or for another reason. One example is the Underwriters Laboratories' (UL) Standard for T-4 certification against combustibility, "Division I Flammable Gases, Vapors, Liquids" under which the highest permitted surface temperature of any component is 200° C. or less when the ambient temperature is 40° C.

Accordingly, it is desirable that electronic circuit board 60 and electrical components 64 thereon, e.g., particularly power transistors, power diodes and resistors, also be thermally coupled to a heat sink for limiting the temperature that they may reach under abnormal, e.g., failure or fault, conditions. To that end, electronic circuit board 60 is located in light source 10 relatively close to heat sink 40 so that heat generated on circuit board 60 may be removed via heat sink 40, as is heat from LED light source 30. Under certain abnormal conditions, even though the total power dissipation may change only moderately, the source of the power dissipation may, however, be entirely different from that under normal conditions, and so an electronic element that normally dissipates only a small or moderate amount of power may, under an abnormal condition, dissipate substantial power.

Specifically, electronic circuit board 60 is located close to heat sink 40 and in a predetermined location by an insulating housing 50. For example, housing 50 may have an interior surface 54 that corresponds to the outer surface 44 of heat sink 40 so that heat sink 40 may slip partially into the forward end of central cavity 56 of insulating housing 50 so as to be in known predetermined position, e.g., spacing, in relation to housing 50. Electronic circuit board 60 may fit into insulating housing 50 from the other or rearward end thereof so as to be in predetermined position relative to heat sink 40, and thereby to define the central cavity 56 which is between electronic circuit board 60 and heat sink 40 and is surrounded by insulating housing 50.

Preferably, central cavity 56 of insulating housing 50 is filled with a thermally conductive material, e.g., as described below, so that electronic circuit board 60, and the electronic elements 64 thereon, are thermally coupled to heat sink 40, e.g., via closed end 46 thereof. Thus, both LED 32 and electronic elements 64 are thermally coupled to heat sink 40 for controlling the temperature thereof, e.g., under normal operating conditions as well as under fault (e.g., failure) or other abnormal conditions.

A two-fold advantage that may obtain from central cavity 56 being filled with a thermally conductive filler is that (1) improved thermal coupling can enable LED 32 and electronic elements 64 to be operated at a lower temperature and/or at a higher current level, and/or (2) the spacing between circuit board 60 and heat sink 40 may be reduced while maintaining a necessary degree of electrical isolation, e.g., that required by an applicable standard, such as a UL standard. Such reduced spacing also aids in reducing the thermal resistance between heat sink 40 and circuit board 60. Thus, a portable light according to the described arrangement may not only be more efficient, but may also be safer, and may also be smaller in size.

The opening in insulating housing 50 that receives an end of heat sink 40 is preferably relatively shallow so that only a part of the surface of outer wall 44 of heat sink 40 fits therein. As a result, heat sink 40 is at least partly exposed, e.g., for the disposing of heat. Insulating housing 50 is typically electrically insulating, but it need not be thermally insulating. However, insulating housing 50 may be made of a thermally-conductive electrically-insulating material, such a plastic that is loaded or filled with small thermally conductive particles or of a metal coated with an electrically insulating layer, e.g., anodized aluminum, if desired.

Typically, electronic circuit board 60 and insulating housing 50 may have complementary projections and recesses so that circuit board 60 fits into insulating housing 50 in a predetermined position. Similarly, heat sink 40 and insulating housing 50 may have complementary projections and recesses so that heat sink 40 fits into insulating housing 50 in a predetermined position. Electrical conductors, such as wires 62, may extend forward from electronic circuit board 60, through holes in closed end 46 of heat sink 40, to connect to LED 32 for providing energizing electrical power, e.g., an electrical voltage, current, or voltage and current, from the electronic circuits of electronic circuit board 60 thereto.

Heat sink 40 preferably has a wall 44 and a fundus or closed end 46. Typically, wall 44 may be a cylindrical wall and fundus 46 may be a circular closed end 46, however, many other shapes and sizes may be utilized. In general, wall 44 provides a relatively large surface, e.g., an external surface, from which heat may be dissipated, e.g., by radiation, by conduction, by convection, or by a combination thereof, and closed end 46 provides two surfaces to which heat to be dissipated may be coupled.

Heat sink 40 is preferably made of a material having a relatively high thermal conductivity, so as to conduct the heat that may be generated by LED light source 30 and/or electronic circuit 60 without light source 30 or circuit board 60 having to rise to a relatively high temperature. Metals typically have relatively high thermal conductivity, and suitable metals include aluminum and copper, and alloys thereof. Thermally loaded materials, such as nylons and other plastics that are filled with a multiplicity of relatively small, highly thermally conductive particles, may also be employed.

Wall 44 and closed end 46 of heat sink 40 define a central cavity 48 into which a heat generating element, e.g., such as LED assembly 30, may be placed so as to couple heat to closed end 46. In addition, a heat generating element, e.g., circuit board 60, may be placed near to closed end 46 so as to couple heat thereto. It is noted that the ability of heat sink 40 to remove heat from closed end 46 does not depend upon the surface, e.g., the interior surface or the opposing exterior surface, of closed end 46, to which the heat source is thermally coupled.

LED light source 30 maybe disposed in the central cavity 48 of heat sink 40 with its heat conductive base 34 close to or abutting the interior surface of closed end 46 so as to be relatively closely thermally coupled thereto. Spacer 36 has a central opening into which LED 32 fits and has a defined periphery and/or thickness so that spacer 36 facilitates properly locating LED assembly 30 with respect to reflector 20 and heat sink 40. The interface between heat conductive base 34 of LED 32 and the interior surface of closed end 46 of heat sink 40 may be a dry interface or may employ a thermally conductive material, e.g., a thermally conductive grease or thermally conductive adhesive to improve thermal coupling.

Reflector 20 has a curved light reflecting surface 26 that directs the light produced by the light source, e.g., LED assembly 30, that is placed in the opening 28 of reflector 20 in a desired manner in a forward direction to exit reflector 20 through forward opening 24. Light reflecting surface 26 may be parabolic or another suitable shape. Reflector 20 may be made of any suitable material, e.g., a metal or a plastic or a metalized plastic. Where it is desired that reflector 20 provide an alternative and/or an additional thermal path for removing heat from LED 32, reflector 20 is preferably of a material having good thermal conductivity and emissivity, such as, e.g., aluminum, copper, magnesium, or a thermally conductive plastic.

Reflector 20 is preferably thermally coupled to heat sink 40 to provide additional mass and surface area that can cooperate with heat sink 40 to limit the temperature rise of light source 30 and of electrical elements 64 of circuit board 60, both in normal operation and under failure or fault conditions. Reflector 20 may have a cylindrical outer surface 22 near the rear end thereof that is preferably sized to slip into cavity 48 of heat sink 40 so as to bring the outer surface 22 of reflector 20 into thermal coupling with the inner surface 42 of heat sink 40. This may be an interference fit, or a slip fit, or a mechanically secured attachment, e.g., by rolling or swaging, and/or thermal coupling may be enhanced by a thermal grease or thermally conductive epoxy or other adhesive.

Further, reflector 20 may have a rear or base end that optionally is in close proximity to spacer 36 and heat conducting base 34 so as to provide additional thermal coupling between LED 32 and reflector 20. Thus the base end of reflector 20 may abut spacer 36 and may exert force via spacer 36 that tends to keep conductive base 34 in close physical contact with closed end 46 of heat sink 40 Further, spacer 36 may be of a thermally conductive material and may be in physical contact with the interior surface 42 of heat sink 40 for providing thermal coupling thereto. Any or all of such physical contacts between elements may optionally include a thermally conductive grease or other thermally conductive interface material for increasing the thermal coupling, i.e. decreasing the thermal resistance, between the contacting elements.

In one example embodiment, electronic elements 64 of electronic circuit board 60 are conformally coated with an electrically insulating thermally-conductive high-temperature silicone encapsulant, and the cavity 56 between electronic circuit board 60 and closed end 46 of heat sink 40 is filled with a thermally-conductive high-temperature epoxy. Suitable materials may include, for example, STYCAST #4954 and #5954 silicone high temperature encapsulants, and STYCAST #4952 epoxy, which are available from Emerson & Cuming located in Billerica, Mass. In addition, the interface between surface 22 of reflector 20 and outer surface 44 of heat sink 40 may be bonded together. Suitable epoxies may include, for example, SCOTCH-WELD DP 190 gray epoxy available from 3M Corporation of Minneapolis, Minn. These materials will withstand temperatures of at least about 255° C.

Rearward of heat sink 40 and electronic circuit board 60 in portable light 100, electrical connections to the battery or batteries, and to the switch or switches, of portable light 100 may be made in any suitable manner. For example, an optional insulating contact holder 70 may be provided for making electrical connections to a battery or batteries 130 of portable light 100. Insulating contact holder 70 may include one or more spring contacts 72 for making connections to electronic circuit board 60 and/or to battery or batteries 130, as may be desired.

Optional contact holder 70 may include various features on the battery-facing side thereof for providing connections to the terminal or terminals of a battery or batteries in portable light housing 110, and may also include projections and recesses for precluding connection to a battery or batteries that are not inserted in the battery cavity of portable light housing 110 in the proper orientation, e.g., may be inserted backwards so that the polarity thereof is opposite the desired polarity.

In the arrangement illustrated in FIG. 3, for example, a negative battery contact, such as contact 74N that fits over the portion 74 of holder 70, has a solid contact on one side thereof that is connected to circuit board 60 via contact spring 72P. The other side of contact 74N is a ring contact that is intended to contact the negative terminal at the usually flat end of a battery. The ring contact of negative contact 74N has an opening in the center thereof so that if a positive terminal of a battery is presented, it will be in the central opening of the ring of negative contact 74N and so not make contact therewith.

Spring contact 72P is intended to provide a connection between a central positive terminal of a battery and electronic circuit board 60 against which it bears. Contact holder 70 has a hole therein through which the axial end of spring 72P extends for contacting the positive terminal of a battery presented thereto. The battery facing end of contact holder 70 has an insulating projecting ring 76 into the center of which the positive terminal of a battery can be placed to contact the axial end of spring 72P. If the generally flat negative end of a battery is presented, ring 76 prevents it from contacting spring 72P.

In one example embodiment of a light producing part 10 for a portable light 100 including the described arrangement, light source 30 includes a one-watt LUXEON® STAR LED light source 32 and circuit board 60 includes electronic circuitry including a power transistor for regulating the current flowing in LED 32 to a predetermined current level, e.g., about one ampere at maximum brightness. Therein, heat sink 40 is made of aluminum and is about 2.5 cm (about 1. inch) in diameter and is about 1.27 cm (about 0.5 inch) in axial length. Reflector 20 is made of aluminum, is about 2.3 cm (about 0.9 inch) in diameter at its rearward end, and is about 3.3 cm (about 1.3 inches) in diameter at its forward end 24. Circuit board 60 is somewhat rectangular with curved ends and has notches therein. Insulating housing 50 is made of plastic and is about 3.1 cm (about 1.2 inches) in diameter. When heat sink 40 and circuit board 60 are positioned in insulating housing 50, they are separated by a distance of about 0.25 mm (about 0.1 inch) which is substantially filled with a STYCAST #5954 thermally-conductive electrically-insulating epoxy available from Emerson & Cuming located in Billerica, Mass., of which a predetermined amount is dispensed by syringe after circuit board 60 is placed into housing 50 and before heat sink 40 is placed therein. Insulating housing 50 and contact holder 70 may be attached by adhesive or heat welding or any other convenient method. The overall length of part 10 is about 5.1 cm (about 2 inches).

Figure 4:
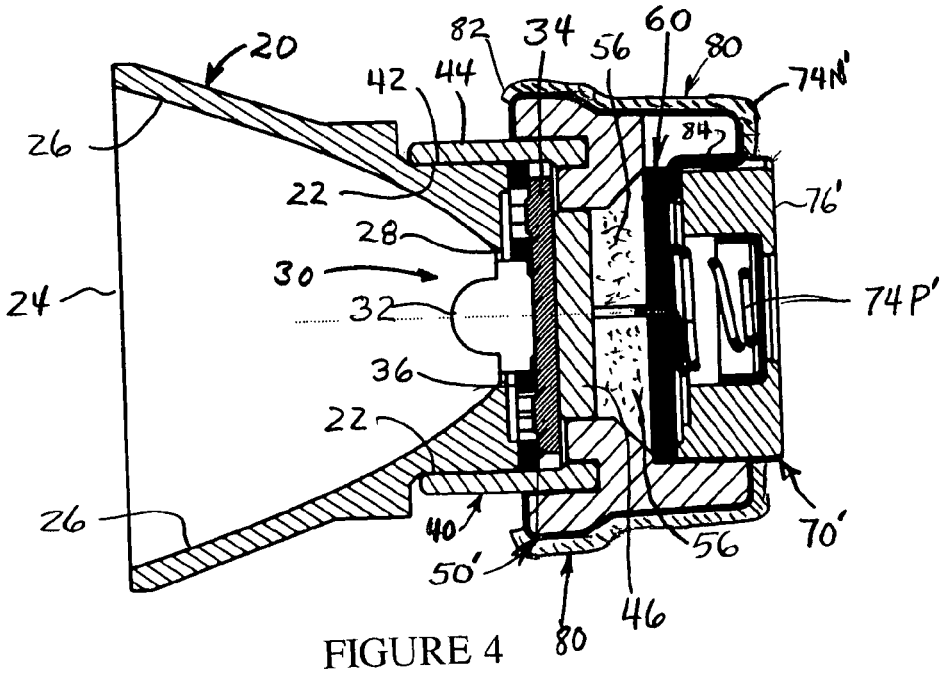
FIG. 4 is a side cross-sectional view of an alternative example embodiment of a part of the portable light of FIG. 1 illustrating the electronic and other elements thereof.

FIG. 4 is a side cross-sectional view of an alternative example embodiment of a part 10' of the portable light 100 of FIG. 1 illustrating the electronic and other elements thereof. Light producing part 10' includes a reflector 20, a light source 30, a heat sink 40, and an electronic circuit board 60, that are substantially the same as those described above. Insulating housing 50' has substantially the same features and provides substantially the same the functions as insulating housing 50 described above, except that its external size and shape differ to accommodate a different optional contact holder 70' for use with a different battery arrangement.

In particular, contact holder 70' is intended to provide contacts to receive a battery having a central terminal, e.g., a central positive terminal, and a concentric ring terminal, e.g., a coaxial annular negative terminal. Contact spring 74P' is positioned in a cavity 78 of contact holder 70' for providing an electrical connection between a central positive battery terminal and circuit board 60 enclosed between insulating housing 50' and contact holder 70'. A ring 76' of insulating material surrounds spring 74P' for preventing the flat negative end of a battery from contacting spring 74P'.

Contact cup 80 provides an annular contact 74N' to which the annular terminal, e.g., usually a negative terminal, of a battery may contact. Contact cup 80 may be, e.g., a generally cylindrical metal sleeve 80 that is slipped over contact holder 70' and insulating housing 50' and is swaged or roll formed at the forward end 82 thereof over the forward end of housing 50', thereby to hold the assembled elements of part 10' together. Electrical connection between contact cup 80 and circuit board 60 may be provided by a wire 84 soldered thereto.

In one example embodiment of a light producing part 10' for a portable light 100 including the described arrangement, light source 30 includes a one-watt LUXEON® STAR LED light source 32 and circuit board 60 includes electronic circuitry including a power transistor for regulating the current flowing in LED 32 to a predetermined current level, e.g., about one ampere at maximum brightness. Therein, heat sink 40 is made of aluminum and is about 2.5 cm (about 1 inch) in diameter and is about 1.27 cm (about 0.5 inch) in axial length. Reflector 20 is made of aluminum, is about 2.3 cm (about 0.9 inch) in diameter at its rearward end, and is about 3.8 cm (about 1.5 inches) in diameter at its forward end 24. Circuit board 60 is somewhat rectangular with curved ends and has notches therein. Insulating housing 50' is made of plastic and is about 3-3.3 cm (about 1.2-1.3 inches) in diameter. When heat sink 40 and circuit board 60 are positioned in insulating housing 50', they are separated by a distance of about 0.25 mm (about 0.1 inch) which is substantially filled with a STYCAST #5954 thermally-conductive electrically-insulating epoxy, of which a predetermined amount is dispensed by syringe after circuit board 60 is placed into housing 50' and before heat sink 40 is placed therein. The overall length of part 10' is about 4.6-4.8 cm (about 1.8-1.9 inches).

The described arrangement is suitable for use with portable lights of many different sizes, shapes and configurations wherein heat sink 40 is located so as to be thermally coupled to a light source 30 and to an electronic circuit, e.g., typically an electronic circuit on a circuit board. Examples of portable lights with which the described arrangement may be utilized may include, for example, the model 4AA and the model 3C LED flashlights which are available from Streamlight, Inc. located in Eagleville, Pa.

A portable light 10, 100 including thermal protection may comprise a cup-shaped thermally-conductive heat sink 40 having a wall 44 and a closed end 46 defining a central cavity 48, the closed end 46 having first and second opposing surfaces, a light-emitting diode 30 having a surface 34 adapted for conducting heat to a heat sink 40, wherein the surface 34 of light emitting diode 30 is in thermal contact with the first surface of the closed end 46 of heat sink 40, an electronic circuit 60 for controlling a voltage, a current, or a voltage and a current, applied to light-emitting diode 30, wherein electronic circuit 60 is adjacent the second surface of the closed end 46 of heat sink 40, and a thermally-conductive material 56 filling between electronic circuit 60 and the second surface of heat sink 40 for providing a thermally conductive path therebetween. Light-emitting diode 30 may be disposed in the central cavity 48 of heat sink 40 abutting the first surface of closed end 46 thereof. Electronic circuit 60 may receive a battery voltage and current and may provide a voltage and current for energizing light-emitting diode 30. The thermally-conductive material may include a thermally-conductive epoxy, a thermally-conductive silicone, a thermally-conductive thermoplastic material, or any combination thereof. Portable light 10, 100 may further comprise a reflector 20 having an opening 28 for receiving a source of light, wherein light-emitting diode 30 is positioned in the opening 28 of reflector 20 for producing light in reflector 20. Portable light 10, 100 may further comprise a portable light housing 120 to which heat sink 40 may be attached, and wall 44 of heat sink 40 may provide a part of an exterior surface of or adjacent to portable light housing 120. Reflector 20 may be a thermally conductive material and may have a surface 22 complementary to the wall 44 of heat sink 40, and the wall 44 of heat sink 40 and the complementary surface 22 of the reflector 20 may be substantially in thermal contact. Portable light housing 120 may have a cavity 125 for receiving a battery 130, and electronic circuit 60 may include one or more terminals 72, 74 adapted for providing an electrical connection in the battery cavity 125 of portable light housing 120.

A portable light 10, 100 including thermal protection may comprise a cup-shaped thermally-conductive heat sink 40 having a central cavity 48 and a fundus 46, a solid state light source 30 having a surface 34 adapted for conducting heat to a heat sink, wherein the surface 34 of solid state light source 30 is in thermal contact with the fundus 46 of heat sink 40, an electronic circuit 60 for controlling a voltage, a current, or a voltage and a current, applied to solid state light source 30, wherein electronic circuit 60 is adjacent the fundus 46 of heat sink 40, and a thermally-conductive material 56 filling between electronic circuit 60 and the fundus 46 of heat sink 40 for providing a thermally conductive path therebetween. Solid state light source 30 may be disposed in the central cavity 48 of heat sink 40 abutting the fundus 46 thereof. Electronic circuit 60 may receive a battery voltage and current and may provide a voltage and current for energizing solid state light source 30. The thermally-conductive material may include a thermally-conductive epoxy, a thermally-conductive silicone, a thermally-conductive thermoplastic material, or any combination thereof. Portable light 10, 100 may further comprise a reflector 20 having an opening 28 for receiving a source of light, wherein solid state light source 30 may be positioned in the opening 28 of reflector 20 for producing light in reflector 20. Portable light 10, 100 may further comprise a portable light housing 120 to which heat sink 40 may be attached, and heat sink 40 may be at least partly exposed exterior to portable light housing 120. Reflector 20 may be of a thermally conductive material and may have a surface 22 complementary to heat sink 40, and heat sink 40 and the complementary surface 22 of reflector 20 may be substantially in thermal contact. Portable light housing 120 may have a battery cavity 125, and electronic circuit 60 may include a terminal 72, 74 providing an electrical connection in the battery cavity 125 of portable light housing 120.

A portable light 10, 100 including thermal protection may comprise a thermally-conductive heat sink 40 having a heat dissipating part 44 and a heat collecting part 46, a light source 30 having a surface 34 adapted for conducting heat to a heat sink, wherein the surface 34 of light source 30 is thermally coupled to the heat collecting part 46 of heat sink 20, an electronic circuit 60 for controlling a voltage, a current, or a voltage and a current, applied to light source 30 wherein electronic circuit 60 is adjacent the heat collecting portion 46 of heat sink 40, and a thermally-conductive material 56 between electronic circuit 60 and the heat collecting part 46 of heat sink 40 for providing a thermally conductive path therebetween. Light source 30 may include a light-emitting diode 32 abutting the heat collecting part 46 of heat sink 40. Electronic circuit 60 may receive a battery voltage and current and may provide a voltage and current for energizing light source 30. Thermally-conductive material 56 may include a thermally-conductive epoxy, a thermally-conductive silicone, a thermally-conductive thermoplastic material, or any combination thereof. Portable light 10, 100 may further comprise a reflector 20 having an opening 28 for receiving a source of light, wherein light source 30 may be positioned in the opening 28 of reflector 20 for producing light in reflector 20. Portable light 10, 100 may further comprise a portable light housing 120 to which heat sink 40 may be attached, wherein the heat dissipating part 44 of heat sink 40 may be at least partly exposed exterior to portable light housing 120. Reflector 20 may be of a thermally conductive material and may have a surface 22 complementary to heat sink 40, and wherein heat sink 40 and the complementary surface 22 of reflector 20 may be thermally coupled. Portable light housing 120 may have a battery cavity 125, and electronic circuit 60 may include a terminal 72, 74 providing an electrical connection in the battery cavity 125 of portable light housing 120.

A flashlight 10, 100 including thermal protection may comprise a cup-shaped thermally-conductive heat sink 40 having a cylindrical wall 44 and a circular closed end 46 defining a central cavity 48, the circular closed end 46 having interior and exterior opposing surfaces, a light-emitting diode 30, 32 in the central cavity 48 of heat sink 40 and having a surface 34 adapted for conducting heat to a heat sink, wherein the heat conducting surface 34 of light emitting diode 30, 32 is in thermal contact abutting the interior surface of the circular closed end 46 of heat sink 40, a circuit board 60 including an electronic circuit 64 for controlling a voltage, a current, or a voltage and a current, applied to light-emitting diode 30, 32, a housing 50 supporting electronic circuit board 60 adjacent the exterior surface of the circular closed end 46 of heat sink 40, wherein the exterior surface of the circular closed end 46 of heat sink 40, electronic circuit board 60 and housing 50 define a cavity 56, and a thermally-conductive material substantially filling the cavity 56 defined between heat sink 40, electronic circuit board 60 and housing 50 for providing a thermally conductive path between electronic circuit board 60 and heat sink 40. Electronic circuit 60, 64 may receive a battery voltage and current and may provide a voltage and current for energizing light-emitting diode 30, 32. The thermally-conductive material 56 may include a thermally-conductive epoxy, a thermally-conductive silicone, a thermally-conductive thermoplastic material, or any combination thereof. Flashlight 10, 100 may further comprise a reflector 20 having a curved light reflecting surface 26 and having a central opening 28 for receiving a source of light, wherein light-emitting diode 30, 32 may be positioned in the central opening 28 of reflector 20 for producing light that is reflected by the light reflecting surface 26 of reflector 20. Flashlight 10, 100 may further comprise a flashlight housing 120 to which heat sink 40 is attached, and the cylindrical wall 44 of heat sink 40 may provide an extension of an exterior cylindrical surface of flashlight housing 120. Reflector 20 may be of a thermally conductive material and may have a cylindrical surface 22 complementary to the cylindrical wall 44 of heat sink 40, and the cylindrical wall 44 of heat sink 40 and the complementary cylindrical surface 22 of reflector 20 may be substantially in thermal contact. Flashlight housing 120 may have a battery cavity 125 for receiving a battery 130, and electronic circuit board 60 may include one or more terminals 72, 74 adapted for providing an electrical connection to battery 130 in the battery cavity 125 of flashlight housing 120.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

While the present invention has been described in terms of the foregoing example embodiments, variations within the scope and spirit of the present invention as defined by the claims following will be apparent to those skilled in the art. For example, circuit board 60 may carry any electronic circuit for regulating or other wise controlling the electrical voltage and/or current that is applied to light source 30. Examples include a switching circuit, an ON-OFF switching circuit, a brightness control, an intensity control, a dimming and/or un-dimming circuit, a voltage regulator, a "buck"-type regulator (both pulse-width modulated and linear), a boost converter, a DC-to-DC converter, a DC-to-AC converter, an inverter, a current regulator, a current limiter, or any other desired circuits, or any combination of the foregoing.

The term "portable light" may include, for example, a flashlight, a lantern, a clip light or any other source of light that is portable, and may be powered by one or more batteries, by connection to a fixed electrical power source, or by any portable source of electrical power.

The terms "electrical" and "electronic" are used interchangeably herein, e.g., when referring to an electrical component or an electronic component. Such components may include resistors, capacitors, inductors, diodes, transistors, microcircuits, integrated circuits, and the like, and any combination thereof.

Finally, numerical values stated are typical or example values, and are not limiting values. Values in any given embodiment may be substantially larger and/or may be substantially smaller than the example or typical values stated.

What is claimed is:

1. A portable light including thermal protection comprising:

a cup-shaped thermally-conductive heat sink having a wall and a closed end defining a central cavity, the closed end having first and second opposing surfaces;

a light-emitting diode having a surface adapted for conducting heat to a heat sink, wherein the surface of said light emitting diode abuts and is in thermal contact with the first surface of the closed end of said heat sink;

an electronic circuit for controlling a voltage, a current, or a voltage and a current, applied to said light-emitting diode, wherein said electronic circuit is adjacent the second surface of the closed end of said heat sink; and a thermally-conductive material filling between said electronic circuit and the second surface of said heat sink for providing a thermally conductive path therebetween, whereby said light-emitting diode and said electronic circuit are thermally coupled to said heat sink.

2. The portable light of claim 1 wherein said light-emitting diode is disposed in the central cavity of said heat sink abutting the first surface of the closed end thereof.

3. The portable light of claim 1 wherein said electronic circuit receives a battery voltage and current and provides a voltage and current for energizing said light-emitting diode.

4. The portable light of claim 1 wherein said thermally-conductive material includes a thermally-conductive epoxy, a thermally-conductive silicone, a thermally-conductive thermoplastic material, or any combination thereof.

5. The portable light of claim 1 further comprising a reflector having an opening for receiving a source of light, wherein said light-emitting diode is positioned in the opening of said reflector for producing light in said reflector.

6. The portable light of claim 5 further comprising a portable light housing to which said heat sink is attached, wherein the wall of said heat sink provides a part of an exterior surface of or adjacent to said portable light housing.

7. The portable light of claim 5 wherein said reflector is of a thermally conductive material and has a surface complementary to the wall of said heat sink, and wherein the wall of said heat sink and the complementary surface of said reflector are substantially in thermal contact.

8. The portable light of claim 1 further comprising a portable light housing to which said heat sink is attached, wherein the wall of said heat sink provides a part of an exterior surface of or adjacent to said portable light housing.

9. The portable light of claim 8 wherein said portable light housing has a cavity for receiving a battery and wherein said electronic circuit includes one or more terminals adapted for providing an electrical connection in the battery cavity of said portable light housing.

10. The portable light of claim 1 further comprising:

a housing supporting said electronic circuit adjacent the second surface of the closed end of said heat sink, wherein the second surface of the closed end of said heat sink sink and said electronic circuit define a cavity that is substantially filled with said thermally-conductive material.

11. A portable light including thermal protection comprising:

a cup-shaped thermally-conductive heat sink having a central cavity and a fundus;

a solid state light source having a surface adapted for conducting heat to a heat sink, wherein the surface of said solid state light source abuts and is in thermal contact with the fundus of said heat sink;

an electronic circuit for controlling a voltage, a current, or a voltage and a current, applied to said solid state light source, wherein said electronic circuit is adjacent the fundus of said heat sink; and a thermally-conductive material filling between said electronic circuit and the fundus of said heat sink for providing a thermally conductive path therebetween, whereby said solid state light source and said electronic circuit are thermally coupled to said heat sink.

12. The portable light of claim 11 wherein said solid state light source is disposed in the central cavity of said heat sink abutting the fundus thereof.

13. The portable light of claim 11 wherein said electronic circuit receives a battery voltage and current and provides a voltage and current for energizing said solid state light source.

14. The portable light of claim 11 wherein said thermally-conductive material includes a thermally-conductive epoxy, a thermally-conductive silicone, a thermally-conductive thermoplastic material, or any combination thereof.

15. The portable light of claim 11 further comprising a reflector having an opening for receiving a source of light, wherein said solid state light source is positioned in the opening of said reflector for producing light in said reflector.

16. The portable light of claim 15 further comprising a portable light housing to which said heat sink is attached, wherein said heat sink is at least partly exposed exterior to said portable light housing.

17. The portable light of claim 15 wherein said reflector is of a thermally conductive material and has a surface complementary to said heat sink, and wherein said heat sink and the complementary surface of said reflector are substantially in thermal contact.

18. The portable light of claim 11 further comprising a portable light housing to which said heat sink is attached, wherein said heat sink is at least partly exposed exterior to said portable light housing.

19. The portable light of claim 18 wherein said portable light housing has a battery cavity and wherein said electronic circuit includes a terminal providing an electrical connection in the battery cavity of said portable light housing.

20. The portable light of claim 11 further comprising:

a housing supporting said electronic circuit adjacent the fundus of said heat sink, wherein the fundus of said heat sink and said electronic circuit define a cavity that is substantially filled with said thermally-conductive material.

21. A portable light including thermal protection comprising:

a thermally-conductive heat sink having a heat dissipating part and a heat collecting part;

a light source having a surface adapted for conducting heat to a heat sink, wherein the surface of said light source abuts and is thermally coupled to the heat collecting part of said heat sink;

an electronic circuit for controlling a voltage, a current, or a voltage and a current, applied to said light source;

a housing supporting said electronic circuit adjacent the heat collecting part of said heat sink, wherein the heat collecting part of said heat sink and said electronic circuit define a cavity therebetween; and a thermally-conductive material substantially filling the cavity between said electronic circuit and the heat collecting part of said heat sink for providing a thermally conductive path therebetween, whereby said light source and said electronic circuit are thermally coupled to said heat sink.

22. The portable light of claim 21 wherein said light source includes a light-emitting diode abutting the heat collecting part of said heat sink.

23. The portable light of claim 21 wherein said electronic circuit receives a battery voltage and current and provides a voltage and current for energizing said light source.

24. The portable light of claim 21 wherein said thermally-conductive material includes a thermally-conductive epoxy, a thermally-conductive silicone, a thermally-conductive thermoplastic material, or any combination thereof.

25. The portable light of claim 21 further comprising a reflector having an opening for receiving a source of light, wherein said light source is positioned in the opening of said reflector for producing light in said reflector.

26. The portable light of claim 25 further comprising a portable light housing to which said heat sink is attached, wherein the heat dissipating part of said heat sink is at least partly exposed exterior to said portable light housing.

27. The portable light of claim 25 wherein said reflector is of a thermally conductive material and has a surface complementary to said heat sink, and wherein said heat sink and the complementary surface of said reflector are thermally coupled.

28. The portable light of claim 21 further comprising a portable light housing to which said heat sink is attached, wherein the heat dissipating part of said heat sink is at least partly exposed exterior to said portable light housing.

29. The portable light of claim 28 wherein said portable light housing has a battery cavity and wherein said electronic circuit includes a terminal providing an electrical connection in the battery cavity of said portable light housing.

30. A flashlight including thermal protection comprising:

a cup-shaped thermally-conductive heat sink having a cylindrical wall and a circular closed end defining a central cavity, the circular closed end having interior and exterior opposing surfaces;

a light-emitting diode in the central cavity of said heat sink and having a surface adapted for conducting heat to a heat sink, wherein the heat conducting surface of said light emitting diode is in thermal contact abutting the interior surface of the circular closed end of said heat sink;

a circuit board including an electronic circuit for controlling a voltage, a current, or a voltage and a current, applied to said light-emitting diode;

a housing supporting said electronic circuit board adjacent the exterior surface of the circular closed end of said heat sink;

wherein the exterior surface of the circular closed end of said heat sink and the electronic circuit board define a cavity therebetween; and a thermally-conductive material substantially filling the cavity defined between said heat sink and said electronic circuit board for providing a thermally conductive path between said electronic circuit board and said heat sink, whereby said light-emitting diode and said electronic circuit board are thermally coupled to said heat sink.

31. The flashlight of claim 30 wherein said electronic circuit receives a battery voltage and current and provides a voltage and current for energizing said light-emitting diode.

32. The flashlight of claim 30 wherein said thermally-conductive material includes a thermally-conductive epoxy, a thermally-conductive silicone, a thermally-conductive thermoplastic material, or any combination thereof.

33. The flashlight of claim 30 further comprising a reflector having a curved light reflecting surface and having a central opening for receiving a source of light, wherein said light-emitting diode is positioned in the central opening of said reflector for producing light that is reflected by the light reflecting surface of said reflector.

34. The flashlight of claim 33 further comprising a flashlight housing to which said heat sink is attached, wherein the cylindrical wall of said heat sink provides an extension of an exterior cylindrical surface of said flashlight housing.

35. The flashlight of claim 33 wherein said reflector is of a thermally conductive material and has a cylindrical surface complementary to the cylindrical wall of said heat sink, and wherein the cylindrical wall of said heat sink and the complementary cylindrical surface of said reflector are substantially in thermal contact.

36. The flashlight of claim 30 further comprising a flashlight housing to which said heat sink is attached, wherein the cylindrical wall of said heat sink provides an extension of an exterior cylindrical surface of said flashlight housing.

37. The flashlight of claim 36 wherein said flashlight housing has a battery cavity for receiving a battery, and wherein said electronic circuit board includes one or more terminals adapted for providing an electrical connection to a battery in the battery cavity of said flashlight housing.

* * * * *